US005401186A

United States Patent [19]

Nozaki et al.

[11] Patent Number: 5,401,186

[45] Date of Patent: Mar. 28, 1995

[54] ELECTRICAL CONNECTION ELEMENT OF CONNECTOR FOR ELECTRIC RIBBON WIRE

[75] Inventors: Takao Nozaki; Masamitsu Chishima, both of Yokkaichi, Japan

[73] Assignee: Sumitomo Wiring Systems, Ltd., Yokkaichi, Japan

[21] Appl. No.: 149,279

[22] Filed: Nov. 9, 1993

[30] Foreign Application Priority Data

Dec. 11, 1992 [JP] Japan ..... 4-090826 U

[51] Int. Cl.[6] ..... H01R 9/07; H01R 23/66

[52] U.S. Cl. ..... 439/495; 439/499; 439/260

[58] Field of Search ..... 439/495, 496, 499, 260, 439/630, 632, 636, 637, 77, 67, 81

[56] References Cited

U.S. PATENT DOCUMENTS

| | | | |
|---|---|---|---|
| 4,241,970 | 12/1980 | Rider, Jr. et al. | 439/403 |
| 4,522,460 | 6/1985 | Beck, Jr. et al. | 439/393 X |
| 4,526,439 | 7/1985 | Aso | 439/499 |
| 4,806,103 | 2/1989 | Kniese et al. | 439/630 X |
| 5,194,017 | 3/1993 | Consoli | 439/495 |
| 5,308,262 | 5/1994 | Chishima | 439/495 |

FOREIGN PATENT DOCUMENTS

| | | | |
|---|---|---|---|
| 466444A | 1/1992 | European Pat. Off. | 439/499 |
| 61-131382 | 6/1986 | Japan . | |
| 3-46976 | 4/1991 | Japan . | |

*Primary Examiner*—P. Austin Bradley
*Assistant Examiner*—Jeanne M. Elpel
*Attorney, Agent, or Firm*—Oliff & Berridge

[57] ABSTRACT

An electrical connection element is formed by stamping a plate having a thickness. A contact surface is formed at an edge surface of an end portion of the electrical connection element. The end edge portion is bent toward both lateral sides of the plate to form the contact surface. The lateral edge portions are offset towards opposite sides of the plate, so that the width between the opposite lateral edges is about twice the thickness of the plate. This edge surface is flat and smooth. Therefore, if the round conductor of a ribbon tape contacts any portion of the contact surface, a good electrical contact is obtained. Thus, the electrical connection element for contacting the side surface of the round conductor of the ribbon wire can be produced from a thin plate material.

10 Claims, 5 Drawing Sheets

ELECTRICAL CONNECTION ELEMENT OF CONNECTOR FOR ELECTRIC RIBBON WIRE

BACKGROUND OF THE INVENTION

1. Field of the Invention

This invention relates generally to a connector for connecting an electric ribbon wire comprising conductors having a round cross-section. Particularly, this invention is drawn to a connector having a smooth, flat, plate-like end portion, an edge of the end portion forming a contact surface, the end portion being bent toward both lateral sides of the connector.

2. Related Art

Electric tape or ribbon wire, in which conductors are often made very thin and are often arranged at a very small pitch, have been used as the internal wiring in household appliances such as VCRs, video cameras, office automation devices, and the like. This ribbon wire comprises electrical conductors, each comprising twisted wire elements, flat conductors, or single wire conductors having a round cross-section (hereinafter referred to as "round conductors"). A suitable ribbon wire is selected and used in accordance with an intended application.

For example, in the electric ribbon wire 4 shown in FIG. 7, a plurality of round conductors 41 each have a diameter d of 0.12 mm. The conductors 41 are arranged in a parallel relation at a pitch D of 0.8 mm. The conductors 41 are covered at their opposite sides by a flexible insulating sheath 42 to provide a ribbon-like, one-piece construction. The insulating sheath 42 is removed from one side of one end of the ribbon wire to expose a portion 43 of the conductors 41. This exposes the side surfaces of the conductors 41. The exposed portion 43 is inserted into a connector which collectively connects the plurality of conductors arranged at the narrow pitch D to a plurality of electrical connection elements arranged within the housing 1.

One conventional electrical connection element (not shown) is disclosed in Japanese Utility Model Unexamined Publication No. 3-46976, in which one end portion of the plate-like element, which has a width corresponding to the pitch of conductors, is bent at an acute angle. The end portion is resilient and acts as a leaf spring. This end portion is urged into contact with the conductor inserted into the housing.

FIG. 8 shows an electrical connection element 51 disclosed in Japanese Patent Unexamined Publication No. 61-131382. The connection element 51 is formed by stamping a plate material, and has an end edge surface (i.e., the surface in the direction of the thickness of the plate) which acts as a contact surface 56. This electrical connection element 51 includes a pair of generally parallel, opposed arms 52 and 53, which are formed into a U-shape. The exposed front end portion of the ribbon wire 4 is inserted into the space between the two arms 52 and 53. A prong 55 of a retainer 54 is used to force the contact surface 56 of the arm 53 into contact with the exposed portion 43 of the conductor 41.

However, with respect to the first above-mentioned conventional electrical connection elements, the pitch D of the conductors is approximately 0.8 mm. Therefore, it is very difficult to produce the leaf spring corresponding to this narrow pitch. Additionally, this electrical connection element is normally not used with a single round conductor. It is possible that the round conductor may be severed by a distal edge of the electrical connection element. Thus, this first conventional electrical connection element has been limited to twisted wire element applications, and has not been suitable for a ribbon wire having round conductors.

The second above-mentioned electrical connection element can be used with a ribbon wire having round conductors. However, since the narrow contact surface 56 must be brought into contact with the thin conductor along its length, the contact surface 56 must be accurately aligned with the exposed conductor. Therefore, if there is a slight manufacturing or assembling error, or if the exposed conductor is bent to the right or to the left, even slightly, the conductor 41 is offset from the electrical connection element 51, as shown in FIG. 9.

As a result, a stable contact cannot be obtained. In the worst case, a contact failure occurs. This can be avoided by making the electrical connection element from a plate having a greater thickness, as shown in FIG. 9, so that the contact surface 56 has a larger width. With this arrangement, however, each connection element-receiving slot of the housing for receiving the electrical connection element 51 must be increased in width. In other words, partition walls of the housing must be reduced in thickness. This makes molding the housing difficult. This also makes it difficult to manufacture the housing having sufficient strength.

SUMMARY OF THE INVENTION

This invention therefore provides for electrical connection element which enables a connector to stably contact the round conductor of an electric ribbon wire.

To solve these problems, in this invention, a contact surface for contacting the conductor is formed at an edge surface of a generally plate-like end portion. The end edge portion is bent toward both lateral sides of the end portion to provide the contact surface. The contact surface is also flat and smooth.

With this arrangement, the edge surface of the generally plate-like end portion of the electrical connection element serves as the contact surface. Therefore, the thickness of this plate is the width of the contact surface. The end edge portion is bent toward both sides and the lateral edges of the bent portions are offset, so that the laterally offset edge portions provide a contact surface having a greater width than the general thickness of the electrical connection element. Therefore, even if the pitch of the conductors is irregular, the widened contact surface is able to contact the conductors. The contact surface is flat and smooth. Therefore, even if any portion of the contact surface is brought into contact with the conductor, the contact surface securely contacts the conductor. Thus, only the width of the end portion serving as the contact surface is increased, so that the thickness of the electrical connection element does not need to be increased.

As described above, in this invention, the contact surface for contacting the conductor is formed at the edge surface of the generally plate-like end portion. The end edge portion is bent toward both lateral sides of the end portion to provide the contact surface which is flat and smooth. With this construction, the contact surface can be widened without increasing the thickness of the plate, and the electrical connection element can positively achieve an electrical connection to the ribbon wire having the round conductors.

BRIEF DESCRIPTION OF THE DRAWINGS

A preferred embodiment of the invention will be described in detail with reference to the following figures, wherein.

DETAILED DESCRIPTION OF THE PREFERRED EMBODIMENTS

One preferred embodiment of the present invention will now be described with reference to FIGS. 1 to 6.

Figure 1:
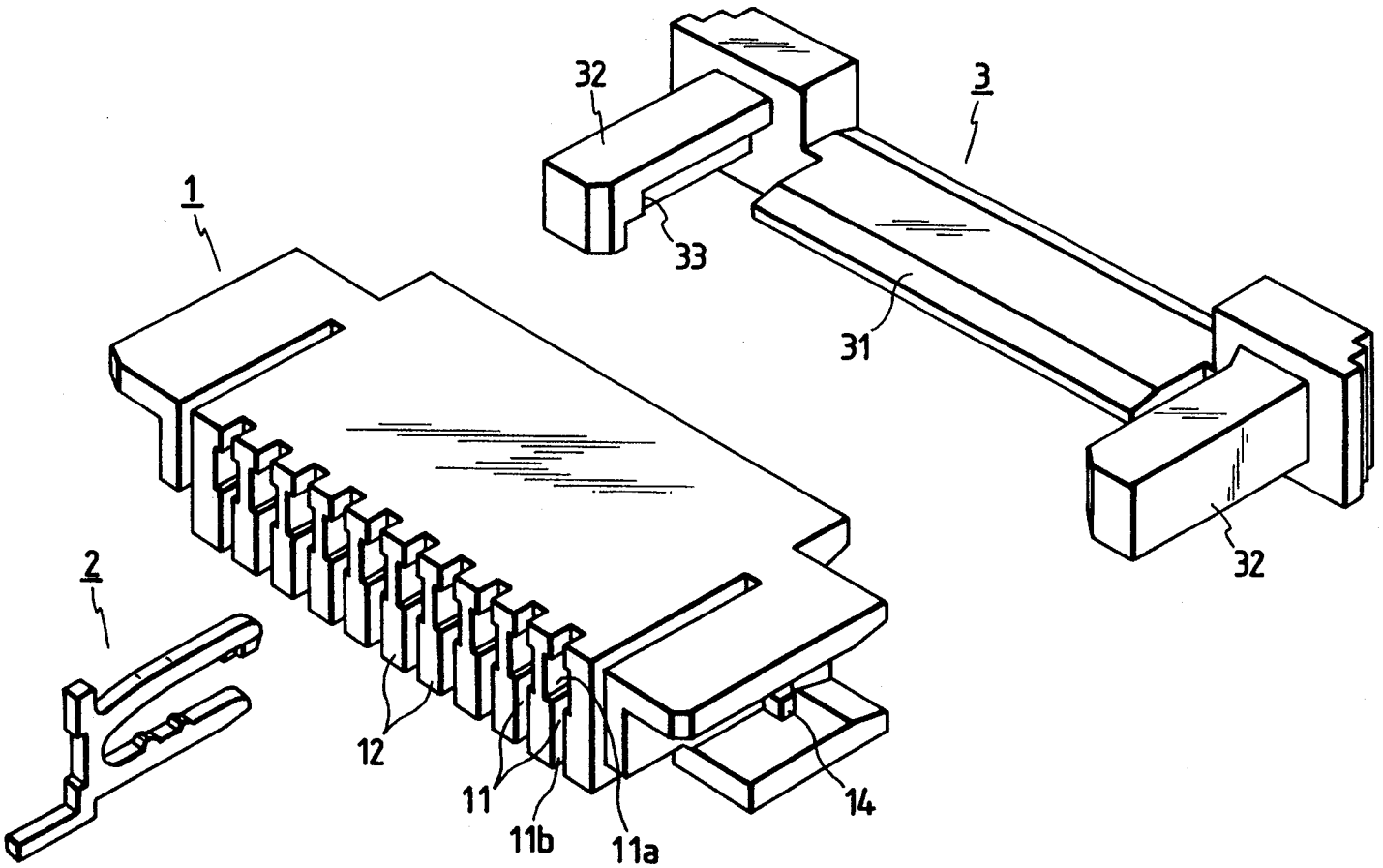
FIG. 1 is an exploded, perspective view of a connector.

As shown in FIG. 1, a connector in this embodiment comprises a housing 1 having a generally rectangular prism shape, a plurality of electrical connection elements 2 (only one of which is shown in the drawings) inserted into the housing 1 from a rear side of the housing, and a retainer 3 inserted into the housing 1 from a front side of the housing. An electric ribbon wire 4 (not shown) is inserted into the housing 1 from its front side, and is fixedly held in the housing 1 by the retainer 3.

The housing 1 has a number of receiving slots 11, each receiving one of the connection elements 2. The receiving slots are positioned at a pitch corresponding to the pitch D of the conductors 41 of the ribbon wire 4. The receiving slots 11 are separated from one another by partition walls 12. A pair of retaining projections 14 are formed on opposite side ends of the housing 1, respectively, and serve to hold the retainer 3 in a provisionally-retained condition relative to the housing 1. The retainer 3 can also be completely retained by a second pair of retaining projections (not shown).

Figure 2:
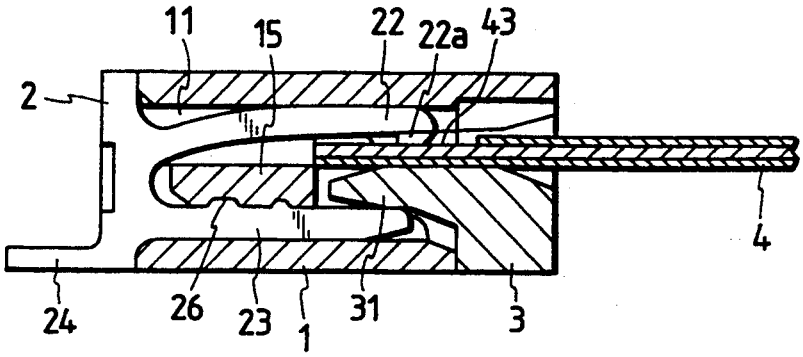
FIG. 2 is a cross-sectional view showing the connector in a completely-retained condition.

As shown in FIG. 2, each receiving slot 11 has a rectangular shape in a direction extending between the front and rear sides. The opening of the slots 11 at the rear side of the housing 1 has a lower narrow portion 11*b* and an upper wide portion 11*a*. Each receiving slot 11 opens to both the front and rear sides of the housing. Additionally, a lateral plate 15 is positioned at a central portion of each receiving slot 11 to divide the receiving slots 11 into upper and lower portions.

Figure 3:
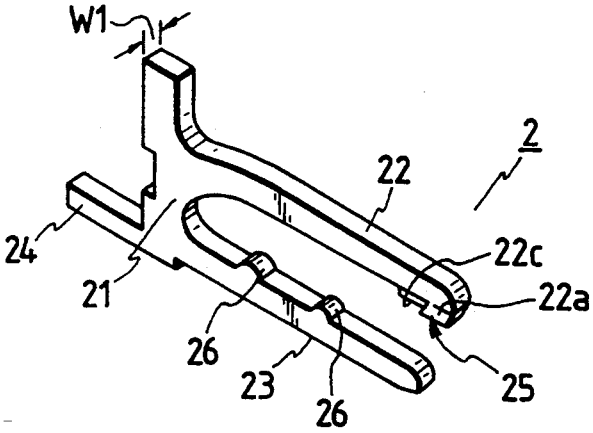
FIG. 3 is a perspective view of an electrical connection element.
Figure 4:
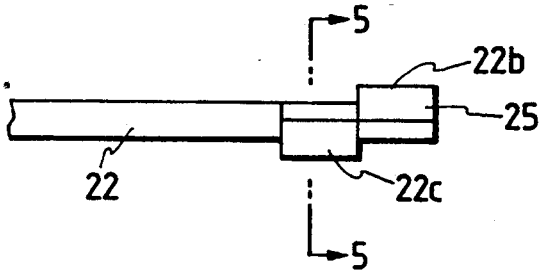
FIG. 4 is a bottom view of a portion of an upper arm of the electrical connection element.
Figure 5:
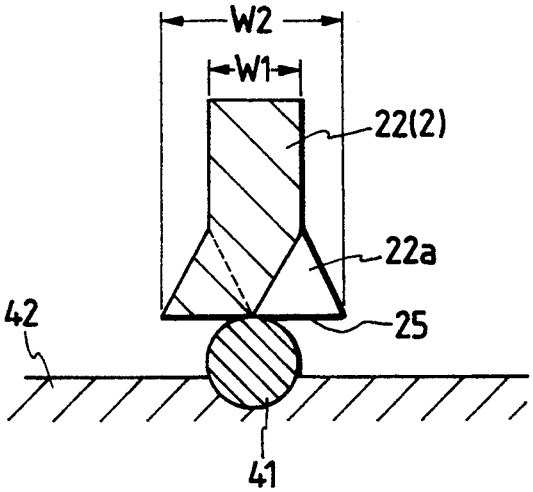
FIG. 5 is a cross-sectional view taken along the line A—A of FIG. 4, showing a conductor contacting a round conductor.
Figure 10:
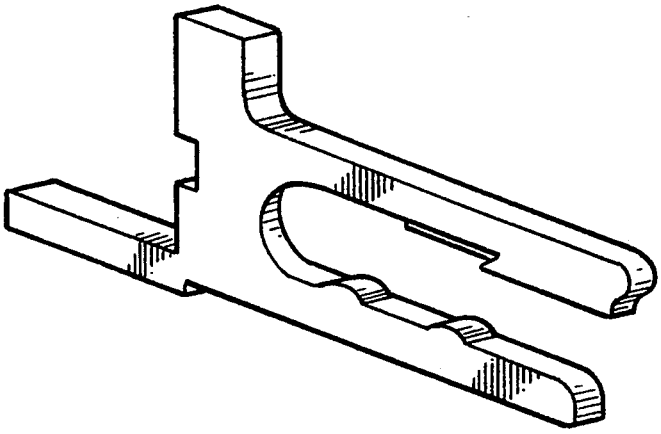
FIG. 10 is a perspective view of an alternative version of an electrical connection element.

The electrical connection element 2 is formed by stamping a plate of a copper alloy (or the like) having a thickness W1. As shown in FIG. 3, the connection element 2 has upper and lower arms 22 and 23 extending generally parallel to each other from an interconnecting portion 21. The arms 22 and 23 and the interconnecting portion 21 cooperate to form the generally U-shape connection element 2. A projection 22*a* is formed on and projects downwardly from a distal end portion of the upper arm 22. A lower portion of the projection 22*a* is bent towards both lateral sides of the upper arm 22. That is, as shown in FIG. 4 a first portion 22*b* of the projection 22*a* extends to the right side of the upper arm 22, while a second portion 22*c* extends to the left side of the upper arm 22. As shown in FIG. 10, an alternative version of the electrical connection element 2 can have the projection 22*a* extending from the free end of the upper arm 22 to a central point of the upper arm 22. A lower surface of the projection 22*a* is formed into a flat, smooth contact surface 25 (as shown in FIGS. 4 and 5). Therefore, the width W2 of the contact surface 25 is generally twice the thickness W1 of the plate. A pair of engagement projections 26 are formed on the upper surface of the lower arm 23. A terminal portion 24 extends rearwardly from the lower end of the interconnecting portion 21.

As shown in FIG. 2, the electrical connection element 2 is inserted into a receiving slot 11 from the rear side of the housing, with the lower arm 23 inserted into the narrow lower portion 11*b* of the slot 11 and the upper arm 22 having the laterally bent projection 22*a* inserted into the wide upper portion 11*a* of the slot 11. The upper and lower arms 22 and 23 extend over and below the lateral plate 15, respectively. The engagement projections 26 can thus engage the lateral plate 15, so that the electrical connection element 2 is securely held in the housing 1. The lateral plate 15 also acts to hold the distal end portions of the upper and lower arms 22 and 23 apart from each other at the front portion of the connection element-receiving hole 11. The ribbon wire 4 can thus be inserted between the upper and lower arms 22 and 23.

The retainer 3 has a wedge portion 31 which fits into the front portion of receiving slots 11. A pair of engagement arms 32 are formed on the opposite ends of the retainer 3, respectively. An engagement portion 33 which engages with the one of the pair of retaining projections 14 is formed on each engagement arm 32 (as shown in FIG. 1). The retainer 3 is inserted into the front side of the housing so that the wedge portion 31 slides over the upper surface of the lower arm 23. At this time, the wedge arm 31 forces the ribbon wire 4 upwardly by contacting the lower side of the ribbon wire 4. The ribbon wire 4 is thus wedged between the wedge portion 31 and the upper arm 23 and is firmly pressed against the contact surface 25 of the upper arm 22.

Next, the operation of this embodiment will be described.

First, each electrical connection element 2 is inserted into one of the receiving slots 11. The engagement projections 26 engage with the lateral plate 15 to hold the connection elements in the slots 11. The retainer 3 is then inserted into the front end of the housing, with the pair of engagement arms extending outside of the sides of the housing 1. The retainer 3 is inserted only to the point at which the engagement portions 33 of the retainer 3 engaged the retaining projections 14, so that the retainer 3 is held in a provisionally-retained condition relative to the housing 1, as shown in FIG. 6.

Figure 6:
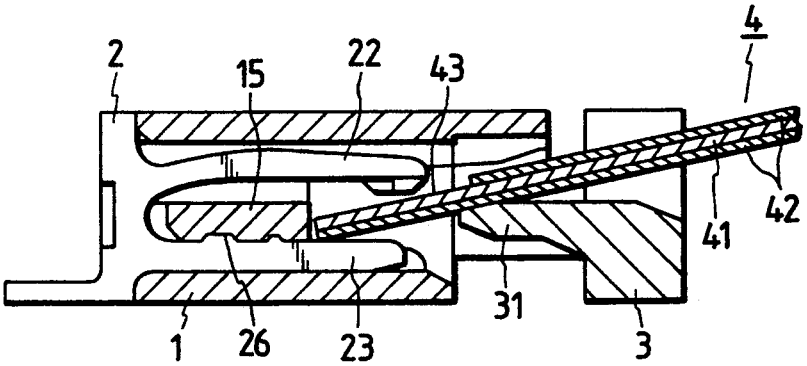
FIG. 6 is a cross-sectional view showing the connector in a provisionally-retained condition.
Figure 7:
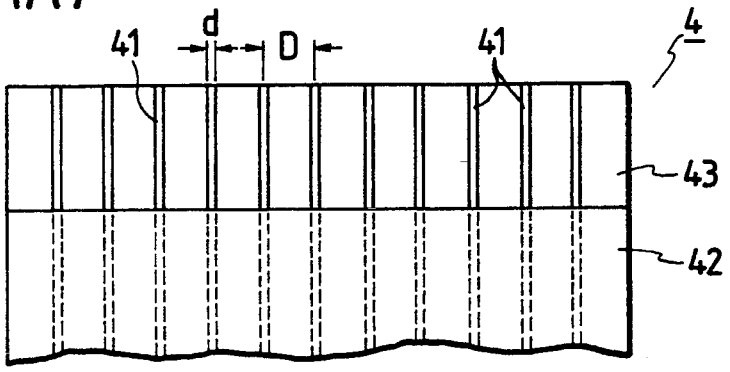
FIG. 7 PRIOR ART
FIG. 7 is a plane view of the ribbon wire.
Figure 8:
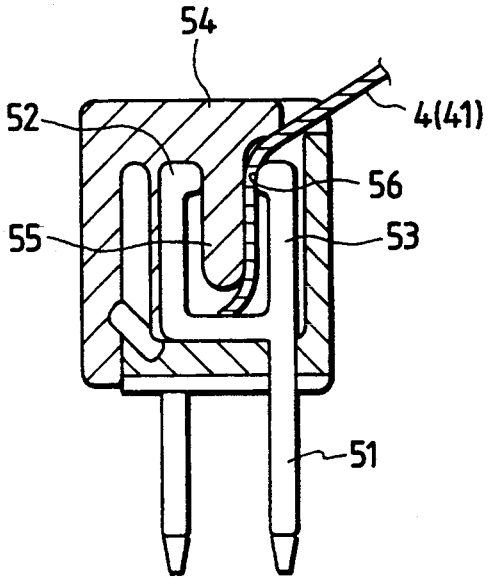
FIG. 8 PRIOR ART
FIG. 8 is a cross-sectional view of a conventional connector.
Figure 9:
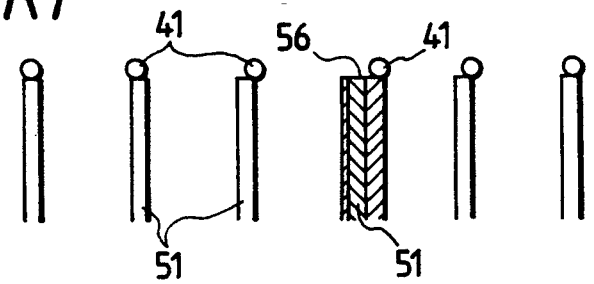
FIG. 9 PRIOR ART
FIG. 9 is an end view of the conventional electrical connection element.

In this provisionally-retained condition, an opening is formed above the engagement portion 31, as shown in FIG. 6. The front end portion of the ribbon wire 4 is inserted into this opening. The ribbon wire 4 has been previously prepared, as shown in FIG. 7, to expose an end portion 43 of the conductors 41. When the ribbon is inserted, the exposed portion 43 is face-up. The ribbon wire 4 is inserted to a predetermined depth, with the front end of the tape wire 4 abutting against the lateral plate 15.

In this condition, the retainer 3 is pushed from the provisionally-retained position deeper into the housing 1 to the completely-retained position, so that the retainer 3 is completely retained relative to the housing 1, as shown in FIG. 2. In this completely-retained position, the wedge portion 31 is positioned between the upper and lower arms 22 and 23, and the tape wire 4 is wedged by the wedge portion 31 into firm contact with the contact surface 25 formed on the lower side of the projection 22*a* of upper arm 22 to achieve an electrical contact.

The projection 22*a* on the distal end portion of the upper arm 22 is bent toward both lateral sides of the upper arm 22. The lower surface of the projection 22*a* is formed into the flat and smooth contact surface 25. The width W2 of the contact surface 25 is about twice the thickness W1 of the connection element 2, as shown in FIG. 5. Therefore, even if the pitch of the conductors 41 is slightly irregular, the contact surface 25 can be firmly pressed against the conductor 41. In addition, since the contact surface 25 is flat and smooth, a good electrical contact is obtained. Furthermore, since the narrow contact surface 25 is pressed against the conductor 41 along the length of the conductor 41 in a parallel relation to the conductor 41, the contact surface 25 will not cut the conductor 41, and can maintain a good electrical contact.

In this embodiment, the electrical connection element 22 has a generally U-shape form, having the upper and lower arms 22 and 23. The contact surface 25 is formed on the distal end portion of the upper arm 22 and the wedge portion 31 of the retainer 3 is inserted in between the upper and lower arms 22 and 23 to retain the ribbon wire 4. Therefore, the connector can be of a simple construction. In this embodiment, the electrical connection element 2 is formed by stamping the plate having the thickness W1, and therefore can be easily produced.

In the above embodiment, although the projection 22*a* is formed on the upper arm 22, it is not always necessary to do so, and the projection 22*a* may be formed on the lower arm 23 so that the ribbon wire 4 can be connected to the lower arm 23.

In the above embodiment, although each portion 22*b* and 22*c* of the projection 22*a* is bent only once to each lateral side of the upper arm 22, the number of projection portions 22*b* and 22*c* of projection 22*a* bent to each lateral side is not limited to one. Further, although only the distal end portion of the upper arm 22 is bent, this is not imperative. Thus, the projection 22*a* may be formed anywhere along the entire length of the upper arm 22 so long as the contact surface is able to contact the exposed portion 43 of the ribbon wire 4. Thus, the projection 22*a* may extend as far as a central point of the upper arm 22.

While the invention has been described with reference to the structure disclosed, it is not confined to the details set forth, but is intended to cover such modifications or changes as may come within the scope of the following claims.

What is claimed is:

1. An electrical connection element of a ribbon wire connector, the ribbon wire connector providing electrical connections to a ribbon wire, the ribbon wire having a plurality of cross-sectionally round wires arranged in a parallel relationship at a predetermined pitch, the electrical connection element comprising:

a first arm having a first thickness in a first direction;

a projection extending from the first arm in both the first direction and a second direction; and a substantially smooth and flat contact surface formed on the projection and engageable with one of the plurality of round wires;

wherein the projection comprises:

at least one first offset portion; and at least one second offset portion, the first and second offset portions being offset on opposite sides of a front end portion of the first arm in a direction parallel to the first direction;

wherein a thickness of the contact surface is greater than the first thickness.

2. The electrical connection element of claim 1, wherein the thickness of the contact surface is twice the first thickness.

3. The electrical connection element of claim 1, wherein the projection is formed on a free end portion of the first arm.

4. The electrical connection element of claim 3, wherein the projection extends from the free end portion to a central point of the first arm.

5. An electrical connection element comprising:

a first arm;

a second arm;

a connecting portion connecting a first end of the first arm to a first end of the second arm;

a terminal portion, a first end of the terminal portion connected to the connecting portion; and a projecting portion extending from one of the first and second arms;

wherein the projection portion comprises:

at least one first electrical contact portion offset in a first direction and having a first surface formed on a free end of the at least one first electrical contact portion; and at least one second electrical contact portion offset in a second direction and having a second surface formed on a free end of the at least one second electrical contact portion;

wherein the electrical connection element has a first thickness, the first and second surfaces forming a flat contact surface having a second thickness greater than the first thickness.

6. The electrical connection element of claim 5, wherein the second thickness is twice the first thickness.

7. The electrical connection element of claim 5, wherein the projection is formed on a free end portion of the first arm.

8. The electrical connection element of claim 5, wherein the projection extends from the free end portion to a central point of the first arm.

9. A ribbon wire connector, comprising:

a plurality of receiving slots;

a plurality of dividing walls separating the receiving slots;

first end portions of the plurality of receiving slots receiving a ribbon wire and a ribbon wire retainer; and a second end portion of each receiving slot receiving an electrical connection element, the second end portion having a first section having a first width and an second section having a second width greater than the first width; wherein:

the electrical connection element has a first arm having a first thickness corresponding to the first width and a second arm having a contact portion having a second thickness corresponding to the second width; and when the ribbon wire is retained in the ribbon wire connector, each wire of the ribbon wire is securely contacted by the contact portion of the corresponding electrical correction element.

10. The ribbon wire connector of claim 9, wherein the second width is twice the first width.

* * * * *